United States Patent [19]

Laufer

[11] Patent Number: 4,594,989

[45] Date of Patent: Jun. 17, 1986

[54] FUEL INJECTION PUMP

[75] Inventor: Helmut Laufer, Stuttgart, Fed. Rep. of Germany

[73] Assignee: Robert Bosch GmbH, Stuttgart, Fed. Rep. of Germany

[21] Appl. No.: 677,173

[22] Filed: Dec. 3, 1984

[30] Foreign Application Priority Data

Dec. 14, 1983 [DE] Fed. Rep. of Germany ..... 3345155

[51] Int. Cl.[4] ..... F02M 39/00

[52] U.S. Cl. ..... 123/502; 417/289; 123/449

[58] Field of Search ..... 123/502, 500, 501, 179 L, 123/449; 417/284, 499, 494, 462, 289

[56] References Cited

U.S. PATENT DOCUMENTS

| | | | |
|---|---|---|---|
| 4,041,919 | 8/1977 | Bonin | 123/502 |
| 4,079,719 | 3/1978 | Uarcoe | 123/502 |
| 4,262,645 | 4/1981 | Kobayashi | 123/502 |
| 4,345,566 | 8/1982 | Hammock | 123/502 |
| 4,359,995 | 11/1982 | Mowbray | 123/502 |
| 4,384,562 | 5/1983 | Hammock | 123/502 |
| 4,450,819 | 5/1984 | Furuhashi | 123/502 |
| 4,478,195 | 10/1984 | Dorenkamp | 123/502 |

*Primary Examiner*—Carl Stuart Miller

*Attorney, Agent, or Firm*—Michael J. Striker

[57] ABSTRACT

A fuel injection pump is provided with an injection start adjustor, in accordance with which an injection adjusting piston is loaded by a pump number of revolutions-dependent fuel pressure of a feed pump against a spring force provided by two pressure springs, of which a first stronger spring in the region of lower number of revolutions acts against a second weaker spring and from a predetermined adjusting path and higher number of revolutions it acts alone.

9 Claims, 5 Drawing Figures

FUEL INJECTION PUMP

BACKGROUND OF THE INVENTION

The present invention relates to a fuel injection pump. More particularly, it relates to a fuel injection pump with adjustment of a supply start and thereby adjustment of an injection start.

An adjustment of the injection start in fuel injection arrangements serves for compensation of time delays which take place during injection process so as to change the supply start of the pump piston relative to respective rotary position of the pump drive. The time delays take place between the pressure increase in the pump and the injection start as well as between the injection start and the combustion start. The pressure transmission from the pump to a nozzle is influenced by the compressibility of the fuel, the running time of the pressure shaft, the pressure increase time to attainment of the opening pressure of the nozzle, and the supply time required for compensation of the unloading volume. Between injection and ignition of the fuel, a so-called ignition delay takes place because of reaction-kinetic grounds. The ignition delay measured in degrees of the crank shaft increases with the number of revolutions and changes simultaneously with the injection start.

In the fuel injection pump of the type to which the present invention belongs, namely with a pump piston drive provided with adjusting means, the injection adjustment is performed in dependence on the number of revolutions. The greater part of the working power of the injection adjustor is used for the compensation of the time delays. The remaining part of the working power serves, depending on the requirements to the size of the internal combustion engine, for improvement of the fuel consumption, the efficiency, the movement hardness and/or the exhaust gases.

In a known fuel injection pump of this type disclosed for example in the U.S. Pat. No. 4,168,940, an adjusting piston for adjusting the pump piston is displaced in the region of idle number of revolutions and low numbers of revolutions against the force of a first spring, till after covering of a predetermined adjusting path, in the medium number of revolutions region a second spring is brought in engagement to provide action in the same direction. Starting from this point, the characteristic line of the injection adjustor extends flatter, whereby first of all the movement hardness is improved without worsening the exhaust gas value. The injection start can thereby be adjusted to the exhaust gas possibilities. The disadvantage of this known arrangement resides in the difficulty because of the outer engagement of the number of revolutions region from which the second spring arrives into engagement. A calibration can be obtained extremely difficult, mainly by dismounting of the injection adjustment and insertion of spacer discs.

A further disadvantage of this known arrangement is its relatively expensive construction. The second spring which normally is substantially weaker than the first continuously operating spring must cooperate with a driving device which is brought in engagement from the region of a medium numbers of revolution. For this purpose a sleeve is provided which is axially displaceable on a housing-fixed pin, and the second spring is clamped between the sleeve and the housing. Starting from a certain number of revolutions and displacement of the injection adjusting piston, this sleeve is driven by the adjusting piston so that the spring is compressed. The thus designed relatively expensive construction brings about the danger of high failure susceptibility.

Since there is here a so-called hydraulic injection adjustor with which the adjusting piston is displaced because of hydraulic forces increasing with the number of revolutions, the characteristic line of this injection adjustor is naturally also changed under the action of the hydraulic pressure. All known solutions are substantially expensive and have the disadvantage of high temperature dependence. It is known that the diesel fuel is considerably more viscous at low temperatures than at high temperatures so that the distortion of the characteristic especially with cold pump takes place.

SUMMARY OF THE INVENTION

Accordingly, it is an object of the present invention to provide a fuel injection pump which not only eliminates the above-mentioned disadvantages of the prior art, but in which also the second spring comes into operation when the characteristic line course is especially critical.

In keeping with these objects and with others which will become apparent hereinafter, one feature of the present invention resides, briefly stated, in a fuel injection pump in which a first stronger spring acts in the region of lower numbers of revolution against a second weaker spring, and starting from a predetermined adjustment path and higher numbers of revolution only the first spring operates.

When the fuel injection pump is designed in accordance with these features it eliminates the disadvantages of the prior art and, as mentioned above, brings the second spring in operation in an especially critical point of the characteristic line. Especially at low numbers of revolution and in idle running, the injection time point can correspond as close as possible to the motor requirements. By the utilization of the second spring in these number of revolutions region, a spring which is determined in the rigidity of the first spring can obtain a characteristic line course which is independent in its characteristic at high numbers of revolution.

A further essential advantage of the inventive fuel injection pump is that for effective operation of both springs and switching off the second spring starting from the predetermined number of revolutions, very simple structural means is provided.

In accordance with one embodiment of the invention, a housing-fixed abutment of the second spring which is switched off at high number of revolutions is changeable from outside. It is thereby possible to adapt the injection adjustor very precisely in the lower number of revolutions region to the motor requirements.

In accordance with a further feature of the present invention, each of the two springs engages with a respective end side of the adjusting piston. Thereby in the lower number of revolutions region, both springs act against one another, wherein one of the springs namely the weaker second spring is arranged in a chamber into which the pressure fluid is pumped.

From the structural reasons, both springs can act on one side of the adjusting piston, and in accordance with a still further feature of the present invention the springs are connected so as to form a spring pile. Such a spring pile can be mounted as a unit or in other words without disassembling.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
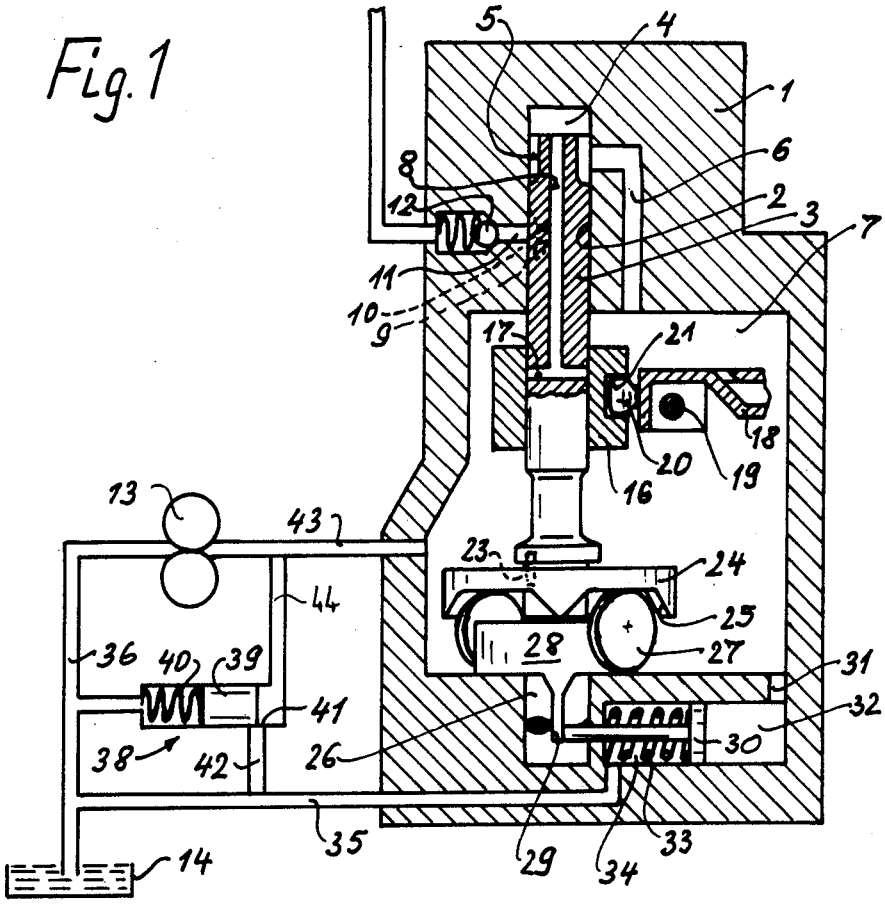
FIG. 1 is a simplified view showing an adjustable fuel injection pump with a hydraulic injection adjustor in a longitudinal section, in accordance with the present invention.

FIG. 1 shows in a simplifier manner a distributor fuel injection pump.

The fuel injection pump has a housing 1 provided with a cylindrical opening 2. A pump piston 3 operates in the cylindrical opening 2 of the housing 1 against the force of a not shown return spring and displaces in a reciprocating and at the same time rotating movement.

A pump working chamber 4 is formed in the housing 1 and supplied with a fuel via longitudinal grooves 5 arranged on the outer surface of the pump piston 3 and via a passage 6 formed in the housing 1, from a suction chamber 7 which is under a negative pressure. The supply of fuel is performed as long as the pump piston performs a downwardly directed suction stroke or assumes its lower dead point position. After beginning of the pressure stroke and immediately after a respective rotation of the pump piston, the passage 6 is closed and the fuel located in the pump working chamber 4 is supplied into a longitudinal passage 8 extending in the pump piston. From the longitudinal passage 8 the fuel is supplied via a branching radial opening 9 and a distributor longitudinal groove 10 provided in the outer surface of the pump piston and shown in broken lines, to one of a plurality of pressure conduits 11 only one of which is shown in the drawing. The actual number of the pressure conduits 11 corresponds to the number of the motor cylinders to be supplied.

The inlets of the pressure conduits 11 are arranged so that they are distributed around the cylinder opening 2. A check valve 12 is provided in the inlet of each pressure conduit 11 and opens in a supply direction.

The suction chamber 7 is supplied with fuel by a feed pump 13 from a fuel container 14. The pump 13 is driven with motor speed-proportional number of revolutions and is formed as a volumetric pump, so that the quantity supplied by the pump proportionally depends on the number of revolutions or in other with increase in the number of revolutions the supplied quantity is also increased.

A control slider or annular slider 16 is arranged axially immovably around the piston pump 3. The control slider 16 controls a radial opening 17 connected with the longitudinal passage 8 during the pressure stroke of the pump piston 3, whereafter the supply into one of the pressure conduits 11 is interrupted since the fuel can flow from the pump working chamber 4 back into the suction chamber 7. With the control of the radial opening 17 the injection is ended.

The control slider 16 is actuated by an intermediate lever 18 which is turnably mounted on an axle 19 fixedly inserted in the housing and engages at its other end with a head 20 in an opening 21 of the control slider 16. The other end of the intermediate lever 18 is engaged by a not shown centrifugal force regulator formed as a number of revolutions signal generator and by a not shown spring which is arbitrarily changeable in its tension and operates against the centrifugal force. The quantity of the injected fuel fixed by the axial position of the control slider 16 is thereby dependent on the number of revolutions and the arbitrarily given spring tension or load.

For transmission of the rotary movement the pump piston 3 is driven by a driving pin 23 which extends in a respective opening of a cam disc 24 provided with end cams 25. The cam disc 24 is fixedly connected with a drive shaft 26 which is driven with the number of revolutions which is synchronous with the motor number of revolutions. The cams 25 cooperate with rollers 27 of a roller rim 28 which imparts the above-mentioned reciprocating movement to the pump piston during rotation of the cam disc and rolling of the end cams 25 over the rollers 27. The number of the cams 25 or the rollers is selected so that the pump and distributor member during one revolution carries out as many pumping strokes as there are cylinders of the internal combustion engine to be supplied by the injection pump .

The roller rim 28 is supported rotatably in the housing 1 and connected via an arm 29 with an injection adjusting piston 30. A displacement of the injection adjusting piston 30 results in rotation of the roller rim 28. Thereby the position of the roller 27 relative to the cams 25 is changed so that the supply start or pressure stroke start of the pump piston 3 is changed relative to the rotary position of the drive shaft 26. This change simultaneously corresponds to the change of the injection start.

The injection adjusting piston 30 is loaded by negative pressure acting in the suction chamber 7 and transmitted via a passage 31 into a chamber 32 located before the end surface of the piston 30. Depending upon the height of this negative pressure, the piston 30 is displaced more or less against the force of at least one first return spring 33, which leads to respective change of the injection start. In accordance with the present invention, as will be described further on, in the several embodiments, a second return spring is also provided in engagement. A chamber 34 which accommodates the springs is connected via an unloading passage 35 with the fuel container 14 or with a suction conduit 36 of the feed pump 13.

The control of the negative pressure in the suction chamber 7 is performed with the aid of a pressure control valve 38. This pressure control valve 38 operates with a piston 39 which is displaceable against a return spring 40 by the fuel supplied from the feed pump 13 and thereby controls more or less a discharge opening 41. A return passage 42 leads from the discharge opening 41 to the suction conduit 36 of the feed pump 13. The feed pump 13 further has a pressure conduit 43 which opens in the suction chamber 7. A control conduit 44 branches from the pressure conduit 43 and leads to the pressure control valve 38.

Figure 2:
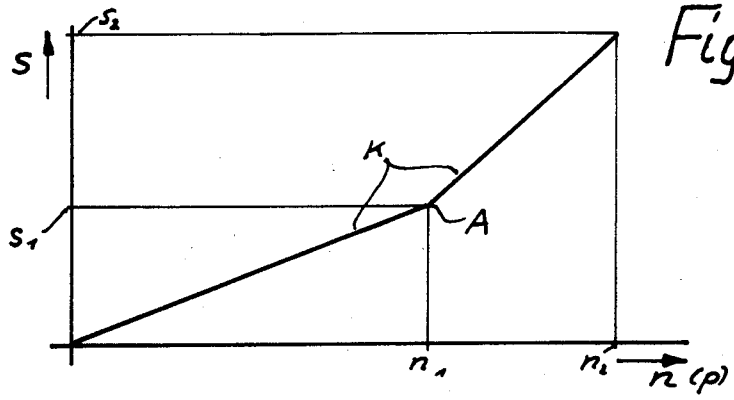
FIG. 2 is a diagram showing the relation between the path of an adjusting piston and the number of revolutions.

FIG. 2 shows a diagram which represents the desired course of the injection adjustor as a characteristic line of injection adjustor path to a number of revolutions. The ordinate of this diagram represents the adjusting path s of the injection adjusting piston 30 and the abscissa represents the number of revolutions of the drive motor 26 or the feed pump 13. The negative pressure p as shown in brackets corresponding to the abscissa and acting in the pump suction chamber 7 and before the injection adjusting piston 30 is proportional to the number of revolutions.

The line k of the inventive injection adjuster must have a respective bend upwardly after a predetermined number of revolutions n, located above the idle running number of revolutions and after covering the adjusting piston path $s_1$ so as to avoid high movement hardness during maintaining of favorable exhaust gas values, as can be seen from the diagram. After this bending point A the injection adjustor with increased number of revolutions provides for a relatively greater displacement of the adjusting piston 30 than before the bending point A. Therefore, as seen from the diagram, an approximately double long adjustment path $s_2$ is obtained with a number of revolutions increased to $n_2$ which is much lower than the doubled number of revolutions of $n_1$.

Figure 3:
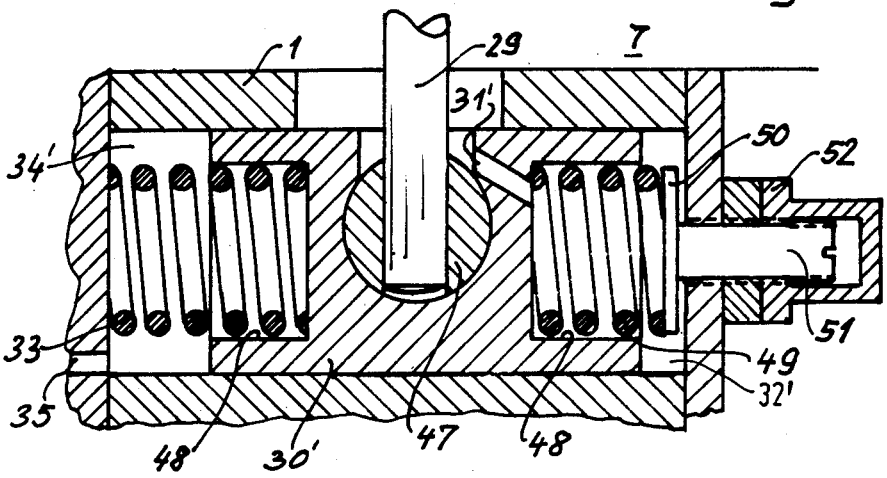
FIG. 3 is a view showing a fragment of FIG. 1, on an enlarged scale, of the first embodiment of the injection adjustor.

FIG. 3 shows a first embodiment of the present invention on an enlarged scale and in a longitudinal section. The arm 29 of the roller rim 28 as shown in FIG. 1 is coupled via a pivot bearing 47 with an injection adjusting piston 30'. The injection adjusting piston 30' supported in the housing 1 has recesses 48 provided at its both end sides. A first return spring 33 and a second return spring 49 are arranged in the recesses 48. The springs support respectively at sides of the housing 1 which are opposite to the injection adjusting piston 30'. They act opposite to one another. The fuel under pressure flows from the suction chamber 7 along the arm 29 and an opening 31' arranged in the injection adjusting piston 30', into a chamber 32' which accommodates the second return spring 49.

With a sufficient negative pressure in the suction chamber 7, the injection adjusting piston 30' is displaced against the force of the first spring 33. This displacement process is supported by the second spring 49. As long as the path $s_1$ shown in FIG. 2 is attained, the spring 49 is released so that the further path of the piston is determined only by the pressure in the suction chamber. Now only the first spring 33 engages the injection adjusting piston 30', so that the pathnumber of revolution line in FIG. 2 extends flatter from the point A.

The second spring 49 is supported at its end facing away from the injection adjusting piston 30' on a spring disc 50 whose initial position is changeable by an adjusting screw 51. The adjusting screw 51 is covered a threaded cup 51 which simultaneously serves for arresting the screw 51. By changing the position of the spring disc 50, the tension of the second spring 49 can be changed so as to thereby determine at which pressure in the suction chamber 7 the injection adjusting piston 30' starts its adjusting path.

Figure 4:
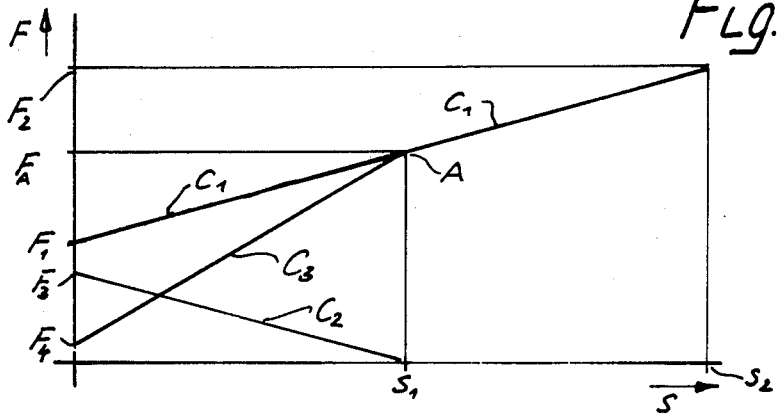
FIG. 4 is a view showing an operational diagram of springs of the injection adjustor with the relation between the spring force and the adjustment path.
Figure 5:
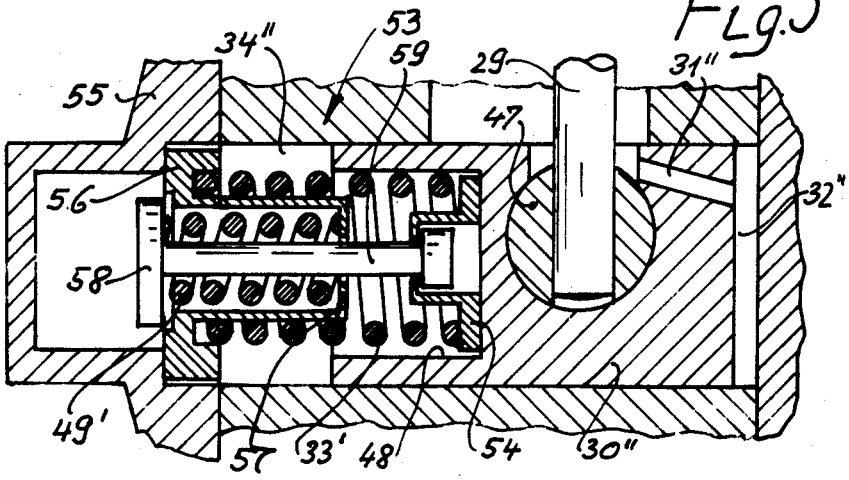
FIG. 5 is a view substantially corresponding to the view of FIG. 3, but showing the injection adjustor in accordance with a second embodiment of the present invention.

FIG. 4 shows a spring diagram which explains the operation of the above described embodiment. In this diagram the abscissa represents the path and the ordinate represents the spring force F. The characteristic line of the first spring 33 is identified as $C_1$ and the characteristic line of the second spring 49 is identified with $C_2$. When the tensioning F of the first spring increases from $F_1$ to $F_2$ over the path from zero to $s_2$, tensioning of the second spring 49 gradually decreases from a pretensioned value $F_3$ until this spring is fully relieved after covering the slider path $s_1$. The addition of the spring force produces the characteristic line $C_3$, namely the difference of $C_1$–$C_2$. After covering the path $s_1$, the first spring 33 acts in correspondence with the characteristic line $S_1$. Thereby this characteristic line experiences after running out of the second spring 49 at A, or covering the path $s_1$ a bend after which it extends flatter in accordance with $C_1$ of the first spring 33 which acts now alone. The pretensioning $F_4$ which acts in the initial position of the control slider 30' before the injection adjusting piston 30' at the sufficient pressure starts its movement, can be influenced by the adjusting screw 51. More particularly, by turning of the adjusting screw 51 the initial pretensioning $F_3$ of the second spring 49 is changed and thereby the difference result $C_1$–$C_2$ in the initial position is also changed.

FIG. 4 shows the second embodiment in a longitudinal section, in which a first spring 33' and a second spring 49' are assembled to form a spring pile 53. This spring pile engages with one side of an adjusting piston 30''. This has the advantage that during dismounting of the springs only one side must be opened, namely a chamber 34'' which accommodates the springs. In other aspects the injection adjusting piston 30'' and the force transmission to the roller rim 25 are formed similarly to the respective parts of the first embodiment. The fuel pressure is also transmitted via an opening 31'' arranged in the injection adjusting piston 30'', to a chamber 32'' which in this example does not accommodate a spring.

The first spring 33'' is supported at its one end on the injection adjusting piston 30'' with interposition of a spring disc 54 and at its other end on a cover 55 which is fixed with the housing with interposition of a cup-shaped part 56. A bottom 57 of the cup-shaped part 56 serves as an abutment for the second spring 49' which supports on the other hand on a pin head 58 anchored with the spring disc 54 by a pin 59.

As long as at sufficient pressure the injection adjusting piston 30'' is displaced against the force of the first spring 33', the hydraulic adjusting force is supported by the second spring 49' and thereby it counteracts the first spring 33'. After covering a predetermined path $s_1$ (see FIG. 4), the second spring 49' is unloaded and displaced as a block from at least one abutment 57 or 58. From this path, now only the first spring 33' acts against the hydraulic adjusting force, so as to provide the desired course of the characteristic line K.

It will be understood that each of the elements described above, or two or more together, may also find a useful application in other types of constructions differing from the types described above.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump, comprising a housing, a piston movable in said housing to supply fuel; a cam drive acting on said pump piston to move the latter and including a first rotatable part and a second part supported in said housing and turnable relative to the first rotatable part against a spring force for changing a supply start and thereby adjusting an injection start; a feed pump having a pump number of revolutions-dependent pressure; and adjusting piston loaded by the pump number of revolutions-dependent pressure of said feed pump and arranged to turn said second part relative to said first part of said cam drive; and spring means arranged to provide the spring force against which said second part is turnable relative to said first part of said cam drive, said spring means including a first stronger spring and a second weaker spring arranged so that said first stronger spring is always in engagement and in the region of lower numbers of revolution acts against said second weaker spring, and starting from a predetermined adjusting path and higher numbers of revolutions only said first stronger spring is active while said second weaker spring is disengaged and displaced as a block.

2. A fuel injection pump, comprising a housing, a piston movable in said housing to supply fuel; a cam drive acting on said pump piston to move the latter and including a first rotatable part and a second part supported in said housing and turnable relative to the first rotatable part against a spring force for changing a supply start and thereby adjusting an injection start; a feed pump having a pump number of revolutions-dependent pressure; an adjusting piston loaded by the pump number of revolutions-dependent pressure of said feed pump and arranged to turn said second part relative to said first part of said cam drive; spring means arranged to provide the spring force against which said second part is turnable relative to said first part of said cam drive, said spring means including a first stronger spring and a second weaker spring arranged so that said first stronger spring is always in engagement and in the region of lower numbers of revolution acts against said second weaker spring, and starting from a predetermined adjusting path and higher numbers of revolutions only said first stronger spring is active; and means forming two end abutments for said second spring, said spring means being formed so that said second spring after the predetermined adjusting path is lifted as a spring block from at least one of said end abutments.

3. A fuel injection pump, comprising a housing, a piston movable in said having to supply fuel; a cam drive acting on said pump piston to move the latter and including a first rotatable part and a second part supported in said housing and turnable relative to the first rotatable part against a spring force for changing a supply start and thereby adjusting an injection start; a feed pump having a pump number of revolutions-dependent pressure; an adjusting piston loaded by the pump number of revolutions-dependent pressure of said feed pump and arranged to turn said second part relative to said first part of said cam drive; and spring means arranged to provide the spring force against which said second part is turnable relative to said first part of said cam drive, said spring means including a first stronger spring and a second weaker spring arranged so that said first stronger spring is always in engagement and in the region of lower numbers of revolution acts against said second weaker spring, and starting from a predetermined adjusting path and higher numbers of revolutions only said first stronger spring is active, said adjusting piston having two opposite ends, said first spring and said second spring being arranged so that each of said springs engages a respective one of said ends of said adjusting piston.

4. A fuel injection pump, comprising a housing, a piston movable in said housing to supply fuel; a cam drive acting on said pump piston to move the latter and including a first rotatable part and a second part supported in said housing and turnable relative to the first rotatable part against a spring force for changing a supply start and thereby adjusting an injection start; a feed pump having a pump number of revolutions-dependent pressure; an adjusting piston loaded by the pump number of revolutions-dependent pressure of said feed pump and arranged to turn said second part relative to said first part of said cam drive; spring means arranged to provide the spring force against which said second part is turnable relative to said first part of said cam drive, said spring means including a first stronger spring and a second weaker spring arranged so that said first stronger spring is always in engagement and in the region of lower numbers of revolution acts against said second weaker spring, and starting from a predetermined adjusting path and higher numbers of revolutions only said first stronger spring is active, said adjusting piston having two ends, said first spring and said second spring being arranged so that they form a spring pile and both engage one of said ends of said adjusting piston; and means forming two abutments for said second spring, said first and second springs having ends facing away from one another, said spring pile having an anchor with two ends which support said opposite ends of said first and second springs, said spring pile having an intermediate spring disc abutting against said housing, so that after covering the predetermined path said second spring is lifted from one of said abutments, whereas said first spring remains active between said spring disc and said adjusting piston.

5. A fuel injection pump as defined in claim 1, wherein said first spring and said second spring are formed as pressure springs.

6. A fuel injection pump as defined in claim 1; and further comprising means forming two abutments for said second spring and arranged so that one of said abutments is provided on said adjusting piston, whereas the other of said abutments is fixed with said housing.

7. A fuel injection pump as defined in claim 6, wherein said second spring acts in a predetermined direction, said other abutment which is fixed with said housing is axially adjustable in said predetermined direction of action of said second spring.

8. A fuel injection pump as defined in claim 1, wherein said adjusting piston has two ends, said first spring and said second spring being arranged so that they form a spring pile and both engage one of said ends of said adjusting piston.

9. A fuel injection pump as defined in claim 4, wherein said first and second springs are arranged coaxially in one another, said intermediate spring disc being cup-shaped.

* * * * *